US005537094A

United States Patent [19]

Bettine et al.

[11] Patent Number: 5,537,094

[45] Date of Patent: Jul. 16, 1996

[54] METHOD AND APPARATUS FOR DETECTING AN EAS MARKER USING A NEURAL NETWORK PROCESSING DEVICE

[75] Inventors: Dale R. Bettine, Coral Springs; Thomas J. Frederick, Coconut Creek, both of Fla.

[73] Assignee: Sensormatic Electronics Corporation, Deerfield Beach, Fla.

[21] Appl. No.: 379,262

[22] Filed: Jan. 27, 1995

[51] Int. Cl.[6] ..... G08B 13/14

[52] U.S. Cl. ..... 340/572; 340/551; 342/42; 342/44

[58] Field of Search ..... 340/572, 551; 395/21–27; 364/554, 602, 2.4, 2.41; 342/44, 42

[56] References Cited

U.S. PATENT DOCUMENTS

| | | | |
|---|---|---|---|
| 4,660,025 | 4/1987 | Humphrey | 340/572 |
| 4,675,657 | 6/1987 | Weaver | 340/572 |
| 4,980,670 | 12/1990 | Humphrey et al. | 340/551 |
| 5,167,008 | 11/1992 | Engeler | 364/602 |
| 5,180,911 | 1/1993 | Grossman et al. | 395/22 |
| 5,349,332 | 9/1994 | Ferguson et al. | 340/572 |
| 5,349,339 | 9/1994 | Kind | 340/572 |
| 5,387,900 | 2/1995 | Plonsky et al. | 340/572 |
| 5,450,492 | 9/1995 | Hook et al. | 340/572 |

OTHER PUBLICATIONS

Robert Schalkoff, *Pattern Recognition–Statistical, Structural and Neural Approaches*, pp. 204–219.

Mark Beale and Howard Demuth, "Building a Neural Network Application," *Scientific Computing & Automation*, May 1992.

Don R. Hush and Bill G. Horne, "Progress in Supervised Neural Networks," *IEEE Signal Processing Magazine*, Jan. 1993, pp. 8–39.

MATLAB, *Neural Network Toolbox User's Guide*, pp. 3–1 to 3–12 and 5–1 to 5–9.

Richard P. Lippmann, "An Introduction to Computing with Neural Nets," *IEEE ASSP Magazine*, Apr. 1987, pp. 4–22.

*Primary Examiner*—Thomas Mullen
*Assistant Examiner*—Benjamin Lee
*Attorney, Agent, or Firm*—Robin, Blecker, Daley & Driscoll

[57] ABSTRACT

A signal received by an electronic article surveillance system is processed using a neural network processing algorithm to determine whether an electronic surveillance marker of a predetermined kind is present. The raw received signal is processed to generate a small number of parameter values to be provided as inputs for the neural network. The neural network processing distinguishes between two different types of surveillance marker.

53 Claims, 7 Drawing Sheets

METHOD AND APPARATUS FOR DETECTING AN EAS MARKER USING A NEURAL NETWORK PROCESSING DEVICE

FIELD OF THE INVENTION

This invention is related to electronic article surveillance (EAS) and more particularly is concerned with detection of an electronic article surveillance marker using neural network processing.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone," the presence of the marker is detected and an alarm is generated. On the other hand, upon proper payment for the merchandise at a check-out counter, either the marker is removed from the article of merchandise or, if the marker is to remain attached to the article, then a deactivation procedure is carried out which changes a characteristic of the marker so that the marker will no longer be detected at the interrogation zone.

In one type of widely-used EAS system, the electromagnetic field provided at the interrogation zone alternates at a selected frequency and the markers to be detected include a magnetic material that produces harmonic perturbations of the selected frequency on passing through the field. Detection equipment is provided at the interrogation zone and is tuned to recognize the characteristic harmonic frequencies produced by the marker, and if such frequencies are present, the detection system actuates an alarm. According to one conventional practice, the marker includes a first type of high permeability magnetic material which exhibits a relatively smooth hysteresis loop characteristic. One example of this first type of material is known as "Permalloy." A disadvantage of this type of material is that the harmonic signals produced by this type of material are not always readily distinguishable from harmonic disturbances caused by coins, keys, belt buckles, metallic articles of merchandise, or other non-marker items that may be brought into the interrogation zone.

U.S. Pat. No. 4,660,025 (issued to Humphrey and commonly assigned with the present application) proposes a second type of material for use in EAS markers. The second type of material has a hysteresis loop characteristic with a substantial discontinuity and represents an improvement as compared to the first type of material, because, for a given strength of interrogation signal, the second type of material generates detectable amplitudes of substantially higher harmonics than the first type of material. These higher harmonics are not likely to be produced by non-marker materials, so that the detection equipment can be tuned in such a manner that it detects the second type of material without generating false alarms in response to non-marker material. Markers incorporating the second type of material are widely used in EAS systems marketed under the trademark "AISLE-KEEPER" by the assignee of the present application.

U.S. Pat. No. 4,980,670 (issued to Humphrey and Yamasaki and commonly assigned with the present application) proposes a third type of magnetic material for use in EAS markers. The third type of material is processed to fix the locations of the walls of magnetic domains in the material so that the material exhibits a hysteresis loop characteristic which, somewhat similarly to the characteristic of the second type of material, has a step change in magnetic flux. The third type of material generates a signal that is rich in high harmonics like the signal generated by the second type of material and thus shares the advantages of the second type of material, while providing certain additional advantages including additional convenience in deactivation.

The disclosures of the above-referenced '025 and '670 patents are incorporated herein by reference.

One of the difficulties encountered in electronic article surveillance is that the amplitude level of the interrogation signal varies from point to point within the interrogation zone. Also, the path along which the article of merchandise with the marker attached is transported through the interrogation zone cannot be practically controlled, so that it is far from certain that the marker will be placed at a point in the interrogation zone where the interrogation field is at a maximum amplitude. Furthermore, the variation in field strength from one point to another in the zone can be quite large, and the harmonic signal generated by a marker present at a point of maximum field strength may be much greater than the harmonic signal generated by a marker which traverses the interrogation zone along a path which avoids the point of maximum field strength. It is therefore necessary, in order to provide reliable detection of all markers of interest, to set the detection equipment to detect relatively low amplitudes of the harmonics produced by the marker. However, as indicated at FIG. 10 of '025 patent, the first type of magnetic material, if exposed to a field of sufficient amplitude, may generate high harmonics at a detectable level and therefore mimic the signature characteristic of the second and third types of material. Of course, a retail establishment using an EAS system designed to detect markers incorporating the second and third types of materials (hereinafter "second and third types of markers") would not intentionally affix a marker including the first type of material (hereinafter "first type of marker") to articles of merchandise sold at the establishment. However, there is an increasing trend in the field of electronic article surveillance for a marker to be incorporated in or packaged with an article of merchandise by the manufacturer or distributor so that the retailer is not required to apply markers to the merchandise. As a result of this practice (known as "source tagging") there may be cases in which a retailer who uses an EAS system designed to detect the second and third types of markers receives in his inventory items that already have the first type of markers incorporated therein. If the retailer is not aware of the presence of the incorporated marker, or for other reasons is not able or willing to deactivate or remove the marker, then false alarms may be occasioned when it happens that the first type of marker is placed in a position in the interrogation zone which results in mimicking of the signature of the second and third types of markers. Such a scenario may also take place, for example, when a customer brings into the store goods purchased at another location and having incorporated therein an active marker of the first type.

Thus, it would be desirable to provide an EAS system in which different types of markers can be reliably distinguished from each other, notwithstanding a tendency of one type of marker to mimic another type of marker under certain circumstances.

It would also be desirable to provide an EAS system which can be set to selectively recognize the presence of only one of two or more types of marker. A retail establishment which had such a system installed would then have flexibility in selecting the type of marker to be used with the system.

More generally, it is desirable that EAS systems be provided which can discriminate with greater precision between signals generated by markers that are of interest and other signals, including noise signals and signals generated by metallic items that are not markers.

OBJECTS AND SUMMARY OF THE INVENTION

It is accordingly an object of the invention to provide an improved electronic article surveillance system.

It is a further object of the invention to provide an electronic article surveillance system having an improved capability for distinguishing between markers intended for use with the system and other items.

It is still a further object of the invention to provide an electronic article surveillance system capable of detecting the presence of more than one type of surveillance marker.

According to an aspect of the invention, there is provided a method of performing electronic article surveillance, including the steps of receiving an analog signal present in an interrogation zone of an electronic article surveillance system, processing the signal to form a plurality of input parameter signals, and processing the plurality of input parameter signals in a neural network processing device to determine whether an electronic surveillance marker of a predetermined kind is present in the interrogation zone.

According to further practice in accordance with this aspect of the invention, each of the plurality of input parameter signals is multiplied by a respective plurality of first weighting values to form a respective plurality of first products, corresponding products from each of the pluralities of first products are summed to form a plurality of first sums, and a respective non-linear function is applied to each of the first sums to produce a plurality of first processed values, with the pluralities of first weighting values, first products, first sums and first processed values all being the same in number. Also, each of the plurality of first processed values is multiplied by a respective plurality of second weighting values to form a respective plurality of second products, corresponding products from each of the pluralities of second products are summed to form a plurality of second sums, and a respective non-linear function is applied to each of the second sums to produce a plurality of second processed values, with the pluralities of second weighting values, second products, second sums and second processed values all being the same in number. Further, each of the plurality of second processed values is multiplied by at least one respective third weighting value to form at least one respective third product, and an output sum set consisting of at least one output sum is formed, with each output sum of the set being formed by summing a respective plurality of the third products, the respective plurality of third products being the same in number as the plurality of second processed values and including third products generated from each of the second processed values, and a respective non-linear function is applied to each output sum to produce a respective output value. In a preferred embodiment of the invention, the output sum set consists of two output sums, so that two output values are produced. One of the two output values is indicative of whether a first type of electronic surveillance marker having a first signature characteristic is present in the interrogation zone, and the other output value indicates whether a second type of electronic surveillance marker having a second signature characteristic different from the first characteristic is present in the interrogation zone. A preferred topology of the neural network processing algorithm described above processes six input parameters by forming eighteen first processed values and nine second processed values, thereby having eighteen nodes in a first hidden layer, nine nodes in a second hidden layer, and two output nodes.

According to other aspects of the invention, a sequence of digital samples is formed from the received analog signal and the six input parameters are formed by applying a fast Fourier transform (FFT) to the sequence of digital samples, combining the resulting coefficient values in a plurality of frequency bands, and normalizing the resulting frequency band values by dividing all of the band values by a selected one of the band values. Preferably, the neural network processing device is made up of an integrated circuit digital signal processing (DSP) device programmed to perform a neural network processing algorithm of the type known as a multi-layer perceptron. Advantageously, the same DSP device is also used to perform the FFT processing and subsequent calculations which produce the input parameter values from a digital signal provided to the DSP device.

According to another aspect of the invention, there is provided an electronic article surveillance system which includes means for generating and radiating an interrogation signal in an interrogation zone, an antenna for receiving an analog signal present in the interrogation zone, analog filter circuitry which filters the analog signal received by the antenna, an analog-to-digital converter for converting the filtered analog signal into a digital signal, and an integrated circuit digital signal processing device which receives the digital signal, calculates a plurality of input parameter values therefrom, and performs a neural network processing algorithm with respect to the input parameter values to determine whether an electronic article surveillance marker of a predetermined kind is present in the interrogation zone.

According to further aspects of the invention, the DSP device is programmed to perform noise-reduction processing on the received digital signal and then performs a fast Fourier transform on the noise-reduced digital signal, combines at least some of the resulting coefficient values within frequency bands to produce frequency band values, and normalizes the frequency band values to produce the input parameter values.

According to another aspect of the invention, there is provided a method of performing electronic article surveillance, including the steps of receiving a signal present in an interrogation zone of an electronic article surveillance system, processing the received signal to determine whether a first type of electronic surveillance marker having a first signature characteristic is present in the interrogation zone, and also processing the received signal to determine whether a second type of electronic surveillance marker having a second signature characteristic different from the first characteristic is present in the interrogation zone.

According to further practice in accordance with the latter aspect of the invention, both of the processing steps are performed substantially simultaneously, by forming a plurality input parameter signals from the received signal and applying a neural network processing algorithm to the plurality of input parameter signals, the algorithm being such that two output signals are produced, each of which is indicative of whether a respective one of the two types of marker is present. According to this aspect of the invention, the first type of marker includes a magnetic element that exhibits a substantially linear hysteresis loop while the second type of marker includes a magnetic element that exhibits a hysteresis loop characteristic having a large non-linearity.

According to yet another aspect of the invention, there is provided a method of discriminating between a first type of article surveillance marker and a second type of article surveillance marker, with the first type of marker exhibiting a signature characteristic that varies, as the first type of marker is transported through an article surveillance interrogation zone, between a first condition in which the signature characteristic is substantially different from a signature characteristic of the second type of marker and a second condition in which the signature characteristic of the first type of marker is similar to the signature characteristic of the second type of marker. The method according to this aspect of the invention includes the steps of receiving signals that are present in the article surveillance interrogation zone at respective times over a predetermined period of time, forming a sequence of samples corresponding to the signals received during the predetermined period of time, analyzing each sample of a first group of samples to detect whether each sample of the first group is indicative of the signature characteristic of the first type of marker, the first group of samples consisting of at least some of the sequence of samples, analyzing each sample of a second group of samples to detect whether each sample of the second group is indicative of the signature characteristic of the second type of marker, the second group of samples consisting of at least some of the sequence of samples, and actuating an alarm if at least a first predetermined number of the samples of the second group of samples is detected as being indicative of the signature characteristic of the second type of marker, unless at least a second predetermined number of samples of the first group of samples is detected as being indicative of the signature characteristic of the first type of marker.

In accordance with further practice according to the latter aspect of the invention, the first and second groups of samples each consist of the sequence of samples, the second predetermined number of samples is one sample, the first predetermined number of samples is two samples, and the alarm is actuated unless the signature characteristic of the first type of marker is detected before the signature characteristic of the second type of marker.

The methods and apparatus provided in accordance with the invention utilize neural network processing to detect two different types of EAS marker using the same detection equipment. Use of neural network processing makes it feasible to map a predetermined number of input parameters into one, two, or more than two output signals, each of which is used for detecting the presence or absence of a respective type of marker. According to the teachings of the present invention, the large quantity of information present in the signal received at the detection portion of the EAS system is processed to form a relatively small number of meaningful input parameters, so that neural network processing can be applied to the detection signal. As a result, even though neural network processing has not heretofore been recognized as applicable to the field of electronic article surveillance, the teachings of the present invention indicate how the detection signal can be processed and distilled down to a small number of parameters to make neural network analysis feasible. Also, the multi-layer perceptron processing makes it possible to provide flexible and precise decision boundaries for distinguishing signals produced by markers of interest from noise and other signals that may be present in the interrogation zone.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
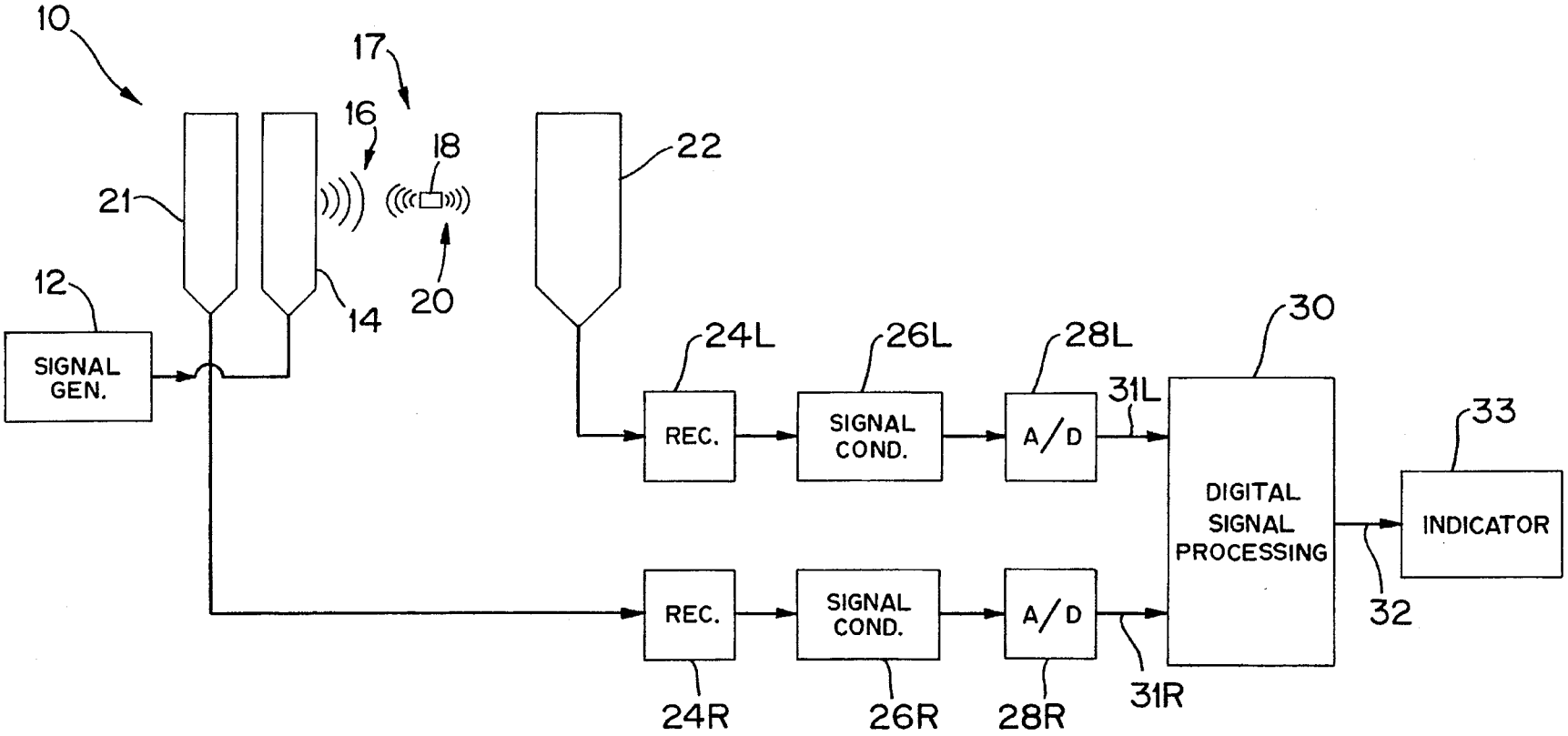
FIG. 1 is a schematic block diagram of an electronic article surveillance system in which neural network processing is employed in accordance with the present invention.

FIG. 1 illustrates in schematic block diagram form an electronic article surveillance system 10 in which the present invention is embodied.

EAS system 10 includes a signal generating circuit 12 which drives a transmitting antenna 14 to radiate an interrogation field signal 16 into an interrogation zone 17. An EAS marker 18 is present in the interrogation zone 17 and radiates a marker signal 20 in response to the interrogation field signal 16. The marker signal 20 is received at receiver antennas 21 and 22 along with the interrogation field signal 16 and various noise signals that are present from time to time in the interrogation zone 17. The signals received at the antenna 22 are provided to a left-channel receiver circuit 24L, from which the received signal is transmitted to left-channel signal conditioning circuit 26L. After analog filtering and/or other analog signal conditioning, the conditioned signal is provided from the circuit 26L to a left-channel analog-to-digital A/D converter 28L which converts the conditioned signal into a digital signal. The resulting digital signal is then provided as a left-channel input signal to a digital signal processing device 30.

The receiver antenna 21 is preferably housed in the same housing (not shown) with transmitting antenna 14. The signal received via the antenna 21 is provided to a right-channel receiver circuit 24R, and is transmitted therefrom to a right-channel signal conditioning signal 26R and then to a right-channel A/D converter 28R. A digital signal output from the A/D converter 28R is provided as a right-channel input signal to the DSP 30.

According to a preferred embodiment of the invention, each of the elements 12, 14, 18, 21, 22, 24L and 24R may be of the type used in the aforesaid "AISLEKEEPER" system. For example, the marker 18 may be of the second type previously discussed or, alternatively, may be of the first or third type.

The signals received via the antennas 21 and 22 and the receiver circuits 24R and 24L are respectively subjected to signal conditioning, such as analog filtering, at the circuits 26R and 26L. For example, in the above-mentioned "AISLEKEEPER" system, the interrogation field signal 16 is generated at a frequency of about 73 Hz. Assuming that the elements 14, 21, 22, 24L and 24R are provided as in the "AISLEKEEPER" system, a filtering function provided in the circuits 26L and 26R may include band pass filtering with a lower limit frequency of about 800 Hz and an upper limit frequency of about 8,000 Hz to attenuate noise at 60 Hz, 73 Hz, and low harmonics of those frequencies, while also attenuating high frequency noise.

The A/D converters 28L and 28R convert the left and right-channel conditioned signals to respective digital input signals 31L and 31R which are provided as inputs for the DSP 30.

The DSP circuit 30 may be realized, for example, by a conventional DSP integrated circuit such as the model TMS-320C31 floating point digital signal processor, available from Texas Instruments.

Figure 2:
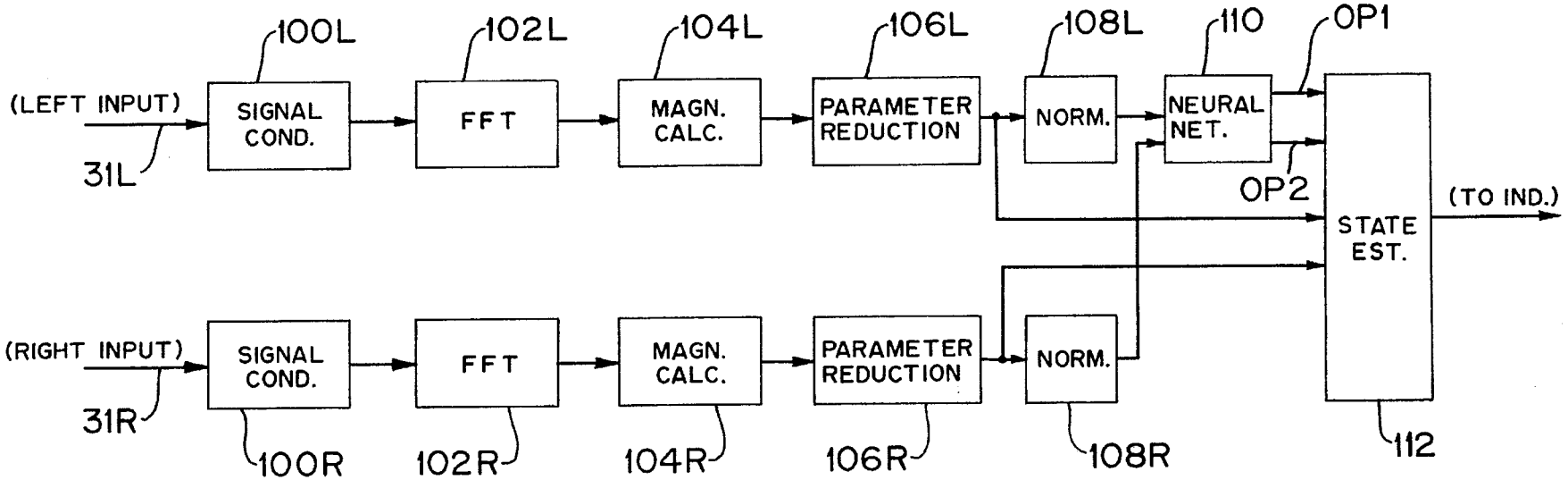
FIG. 2 illustrates in block-schematic form signal processing carried on in a digital signal processing component of the system of FIG. 1.

FIG. 2 illustrates in a schematic form the signal processing carried out in the DSP circuit 30. It will be understood that the processing to be described is carried out under the control of a stored program which controls the operations of the DSP circuit 30. (The program memory in which the program is stored is not separately shown.) The purpose of the processing illustrated in FIG. 2 is to detect whether an active marker 18, of the type or types (e.g., the second and third types of markers discussed above) intended for use with the system 10, is present in the interrogation zone 17.

According to preferred practices of the invention, the DSP 30 also operates to detect whether a marker of the first type is present in the interrogation zone 17, and the DSP 30 also distinguishes between a marker of the first type, on one hand, and markers of the second and third types, on the other hand. Upon detecting the presence of an active marker of the second or third type in the interrogation zone 17, the DSP 30 operates to send an alarm actuation signal 32 to an indicator device 33. The indicator device 33 responds to the alarm actuation signal 32 by, for example, by generating a visible and/or audible alarm or by other appropriate action.

Referring, then, to FIG. 2, the DSP 30 initially performs digital signal conditioning on the input signals 31L and 31R, as indicated by blocks 100L and 100R. For example, it is contemplated that the processing at blocks 100L and 100R may include detection of stationary noise in the input signals 31L and 31R and generation of a noise-cancellation signal that is 180° out of phase with the detected noise. The noise-cancellation signal is then fed back via a feedback path and a digital-to-analog converter (which are not shown) for addition to the input analog signal at an adder (not shown) positioned upstream from A/D converters 28L and 28R.

According to another noise reduction technique implemented in accordance with a preferred practice of the invention, digital input signal samples received over a plurality of cycles of the interrogation field signal 17 are stored, and then corresponding samples from each of the field signal cycles are averaged to generate a block of averaged samples. A specific example of this technique will now be described with reference to FIG. 2A.

It will be assumed for the purposes of the example that the interrogation field signal 17 is at a frequency of 73.125 Hz, and the sampling rate of each of the A/D converters 28L and 28R is 18.72 kHz, so that 256 digital samples are produced in each channel during each cycle of the interrogation field signal.

According to this example, the samples produced during 32 cycles of the interrogation field signal are stored and the corresponding samples from each cycle are averaged to produce 256 averaged samples. Considering the left-channel first, 8,192 serially-received left-channel input samples, $SIPL_k$(k=1, 2, . . . , 8192) generated during the 32 interrogation field cycles occurring over the period from time T1 to time T5 are averaged according to the following formula to form a block of 256 left-channel averaged output samples $AOPL_i$(i=1, 2, . . . , 256):

$$AOPL_i = (1/32) \sum_{j=0}^{31} SIPL_{i+256j} \quad (1)$$

It will be recognized from equation (1) that each sample is the average of 32 input samples which occupy corresponding positions in 32 consecutive cycles of the interrogation field signal. This averaging tends to suppress effects of noise.

The next block of averaged samples for the left channel is generated from an updated block of input samples, formed by replacing the oldest 2,048 samples (8 interrogation field cycles) with samples obtained during the 8 cycles occurring between times T5 and T7, so that the next block of samples to be averaged represents the period from time T3 to time T7.

Similarly, the right-channel average samples are generated according to the formula $$AOPR_i = (1/32) \sum_{j=0}^{31} SIPR_{i+256j} \; (i = 1, 2, \ldots, 256) \quad (2)$$

in the same manner as in the left-channel and with the same timing.

The process continues, with successive windows or blocks of 8,192 samples being generated in each channel. Each block overlaps with the immediately preceding and succeeding blocks in the same channel to the extent of one-quarter of a block, or 2,048 samples.

As indicated in FIG. 2 at blocks 102L and 102R, the blocks of 256 averaged samples produced in each channel are subjected to a fast Fourier transform (FFT) to generate coefficient values. Then, at blocks 104L and 104R, magnitude values are calculated from the real and imaginary coefficients resulting from the processing at blocks 102L and 102R.

At the next step, as represented by blocks 106L and 106R, the quantity of values produced in blocks 104L and 104R is substantially reduced by combining the values in each channel within the following frequency bands: 0–1 kHz, 1–2 kHz, 2–3 kHz, 3–4 kHz, 4–5 kHz and 5–6 kHz. The remaining (i.e. higher frequency) magnitude values are disregarded. As a consequence, after the processing of blocks 106L and 106R, only six parameter values, representing the combined magnitudes in each of the six frequency bands, are present in each of the channels. Next, at steps 108L and 108R, the six parameter values in each channel are normalized by dividing each of those parameters by the value of the parameter obtained for the 1–2 kHz frequency band. It is noted that this frequency band is selected because the parameter value for that band has the highest value, so that all of the resulting normalized parameter values fall in the numerical range of zero to one.

The groups of six parameters produced in each of the left and right channels are processed in alternating fashion according to a neural network algorithm, represented by block 110 in FIG. 2.

It will be recalled that, at processing blocks 100L and 100R, a block of averaged samples is produced in each channel at a rate of once every 8 cycles of the interrogation field signal, which in a preferred embodiment is about 73 hz. As a result, a block of averaged samples is produced in each channel about nine times per second. This timing is maintained through the subsequent processing carried out in blocks 102L, 102R through 108L, 108R, and as a result, during each second roughly 18 groups of six parameter values each (i.e., approximately, nine groups per channel per second) are presented for the neural network processing represented by block 110. The neural network processing is performed alternately on groups of parameter values from the left and right channels, respectively.

The neural network processing represented by block 110 will now be described with reference to FIG. 3.

Figure 3:
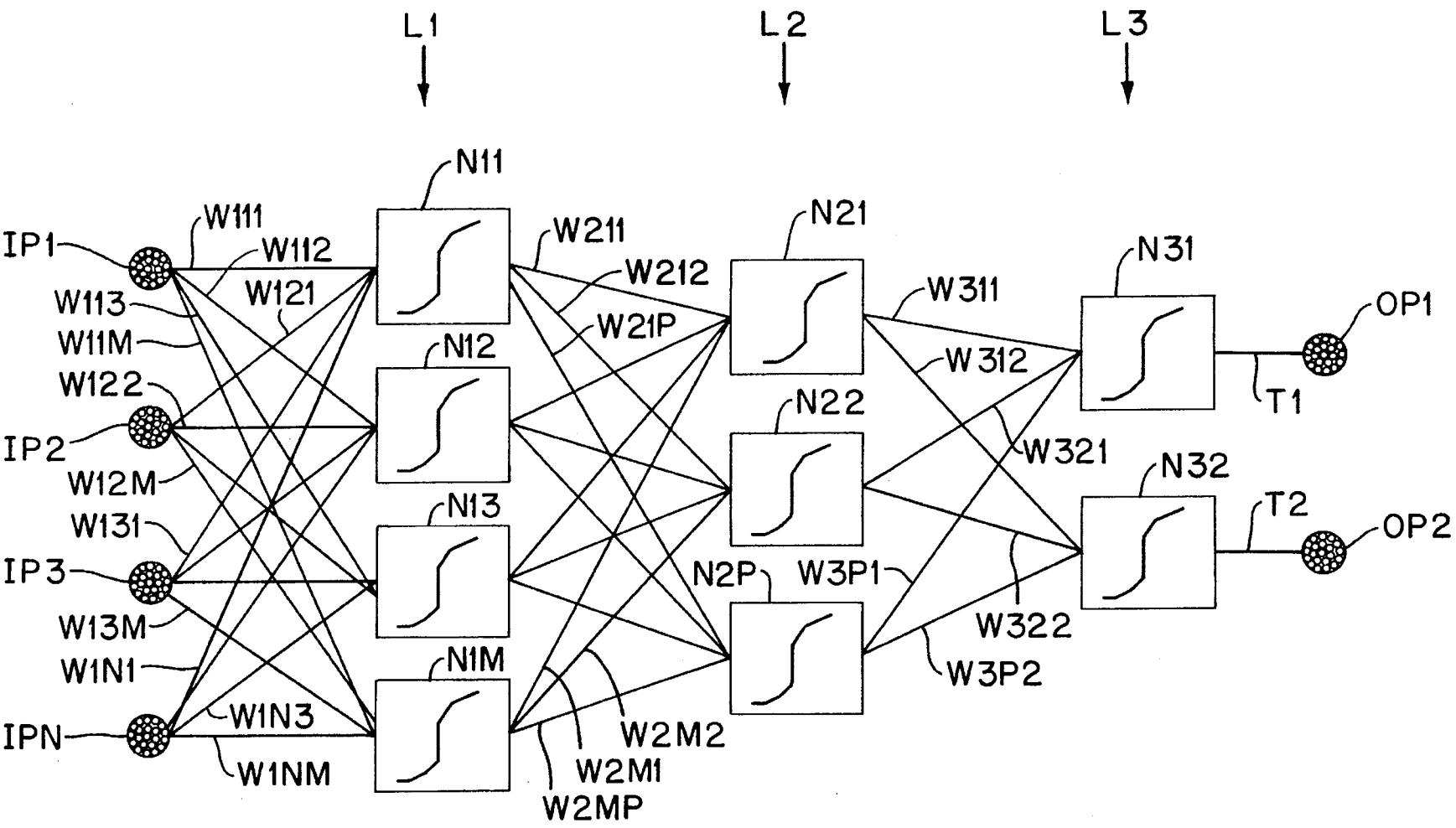
FIG. 3 schematically illustrates a neural network processing portion of the signal processing illustrated in FIG. 2.

The neural network processing algorithm illustrated in FIG. 3 is of the type known as a "multi-layer perceptron." The processing represented in FIG. 3 is performed with respect to N input parameters IP1, IP2, . . . , IPN. In the embodiment as described up to this point, it will be noted that the number of input parameters N is 6, since the signal conditioning and parameter reduction operations previously described with respect to blocks 100L, 100R to 108L, 108R, resulted in sets of six input parameters being formed for neural network processing.

Continuing to refer to FIG. 3, the processing carried out on the input parameters is performed at three layers L1, L2, and L3 of "nodes." The first two layers, L1 and L2, are considered "hidden" layers and the last layer, L3, is an output layer, at which output values are produced.

The first hidden layer L1 consists of M nodes, N11, N12, . . . , N1M. The second hidden layer L2 consists of P nodes, N21, N22, . . . N2P. The output layer L3 consists of two output nodes, N31 and N32. Output values OP1 and OP2 are respectively produced at the nodes N31 and N32.

It has been found that satisfactory processing results are obtained in the EAS system according to the invention if the perceptron shown in FIG. 3 is defined with 18 nodes in the first hidden layer L1 (i.e., M=18), and 9 nodes in the second hidden layer L2 (i.e., P=9). As will be seen, each of the output values OP1 and OP2 is taken as being representative of the presence or absence of a respective type of EAS marker.

Each of the lines interconnecting the input parameters IPI-IPN and the nodes N11-N1M is representative of the multiplication of the respective input parameter by a weighting coefficient W111, . . . , W1NM.

In particular, the first input parameter IP1 is multiplied by each of M weighting coefficients W111, W112, . . . W11M, to produce M respective products, and each of the products is provided as an input to a corresponding one of the nodes, N11 to N1M.

Similarly, each of the other input parameters is multiplied by a respective plurality of M weighting coefficients and the resulting products are provided as inputs to the corresponding nodes of the first hidden layer L1. At each of the nodes of the layer L1, the products representing the inputs for the nodes are summed, and then a non-linear function is applied to the resulting sum to provide a value that is the output of the node.

Figure 4:
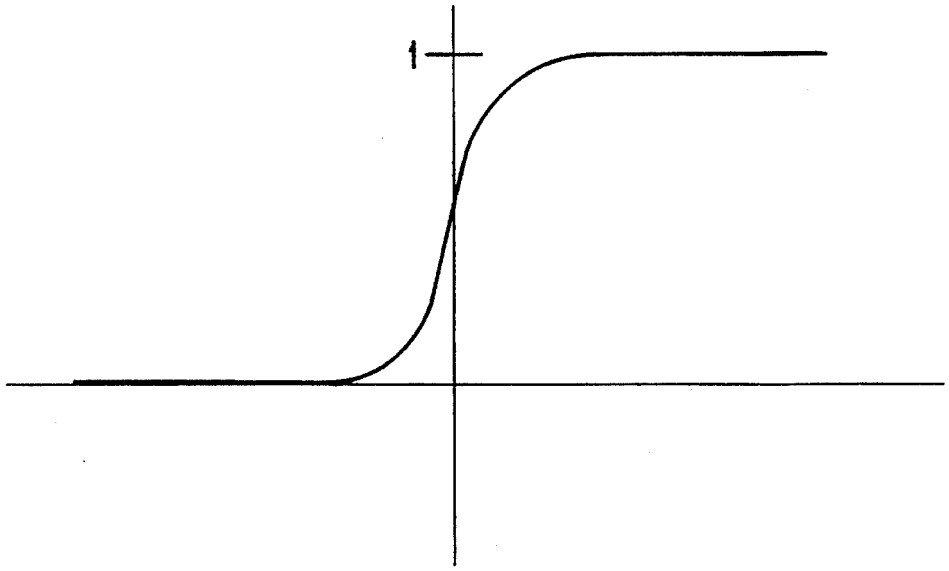
FIG. 4 is a graphical illustration of a non-linear function applied as part of the neural network process illustrated in FIG. 3.

According to a preferred embodiment of the invention, the non-linear function applied at each node is a log-sigmoid function. A graph representing such a function is shown in FIG. 4, in which the horizontal axis represent the input values for the function and the vertical axis represent the corresponding output values for the function. It will be recognized that the function shown in FIG. 4 maps inputs in the range from $-\infty$ to $+\infty$ into the interval [0,1]. Although FIG. 4 indicates that an input value of zero is mapped by the function into an output value of one-half, nevertheless, it should be noted that, as is commonly done with perceptrons, each of the nodes is also characterized by a bias value $\theta$ which shifts the rising portion of the function to the left or to the right.

Each of the nodes N11 to N1M is completely characterized by a respective bias value and the values of the weighting coefficients used to produce the products supplied as inputs to the node. Thus, the output Uk Of the kth node Nlk of the first hidden layer L1 can be written as follows:

$$u_k = F\left(\left(\sum_{i=1}^{N} IPi \cdot W1ik\right) - \theta_k\right) \tag{3}$$

where F is the log sigmoid function discussed above and $\theta_k$ is the bias value associated with node N1k.

Each of the node output values $u_k$ output from the nodes of layer L1 are multiplied by a corresponding group of weighting coefficients W2k1, W2k2, . . . W2kP, and the resulting products are each supplied as inputs to the corresponding nodes N21-N2P of the second hidden layer L2. As before, the products provided as inputs to each node are summed and a non-linear function (log sigmoid) with an offset value corresponding to the node is applied to produce the node output. In other words, the output value $v_k$ of the kth node of the layer L2 is written as:

$$v_k = F\left(\left(\sum_{i=1}^{M} u_i \cdot W2ik\right) - \theta_k'\right) \tag{4}$$

where $\theta'_k$ is the bias value associated with node N2k.

The output value $v_k$ of each node N2k is multiplied by weighting coefficients W3k1 and W3k2 and the corresponding products are respectively supplied as inputs to the output layer nodes N31 and N32. Again, the products supplied as inputs to each node in the output layer L3 are summed, and a non-linear function (log sigmoid) with a bias associated with the node is applied to the resulting sum to produce the network output value corresponding to that node. In particular, the output values OP1 and OP2 are calculated as follows:

$$OP1 = F\left(\left(\sum_{i=1}^{P} v_i \cdot W3i1\right) - \theta_1''\right) \tag{5}$$

$$OP2 = F\left(\left(\sum_{i=1}^{P} v_i \cdot W3i2\right) - \theta_2''\right) \tag{6}$$

where $\theta''_1$ and $\theta''_2$ are the bias values associated with nodes N31 and N32, respectively.

It will be recognized that each of the output values OP1 and OP2 can vary in the range between 0 and 1, inclusive. Also, the overall effect of the processing algorithm illustrated in FIG. 3 is to map six input parameters within that range into two output parameters within that range.

The weighting coefficients and the node bias values required to define the nodes making up the neural network processing algorithm are determined in a training procedure which will be described below. After those values are determined, the same are stored in the DSP 30 or a separate memory (not shown) associated with DSP 30 to implement the neural network described above.

The first output value OP1 can be interpreted as representing a probability that an EAS marker of the first type is present (i.e., is represented by the set of six input parameter values just processed) while the second output value OP2 is indicative of a probability that a marker of the second or third type is present. It has been found that the respective signatures of the second and third types of markers are sufficiently similar that the two types of markers can be treated as a single type and can be used interchangeably with the kind EAS equipment described above. However, because the first type of marker has, in some cases, a signature that can be mistaken for that of the second type of marker, it is necessary to carry out further processing, represented by a state estimator block 112 (FIG. 2) in order to prevent false alarms that would otherwise result from mistaking the first type of marker for the second. The inputs for the processing at the state estimator block 112 are the outputs OP1 and OP2 produced by the neural network block 110, and also the raw frequency band values produced at the parameter reduction blocks 106L and 106R.

Initially at block 112, a thresholding function is applied to each of the values OP1 and OP2, whereby a value of 0.7 or greater is taken to be a "1," i.e., an indication of the presence of the respective type of marker signature, and a value of less than 0.7 is taken to be a "0."

A first technique for disregarding false alarms engendered by a "second type" signature that is actually caused by a first type of marker is based on the fact that the first type of marker tends to produce signals that have a much higher energy level than the signals generated by the second type of marker. For this purpose, the outputs taken directly from the blocks 106L and 106R are compared with a threshold, and if the signal energy exceeds that threshold, then an output OP2 having the value "1" is considered to be indicative of a marker of the first type rather than a marker of the second type.

Figure 5:
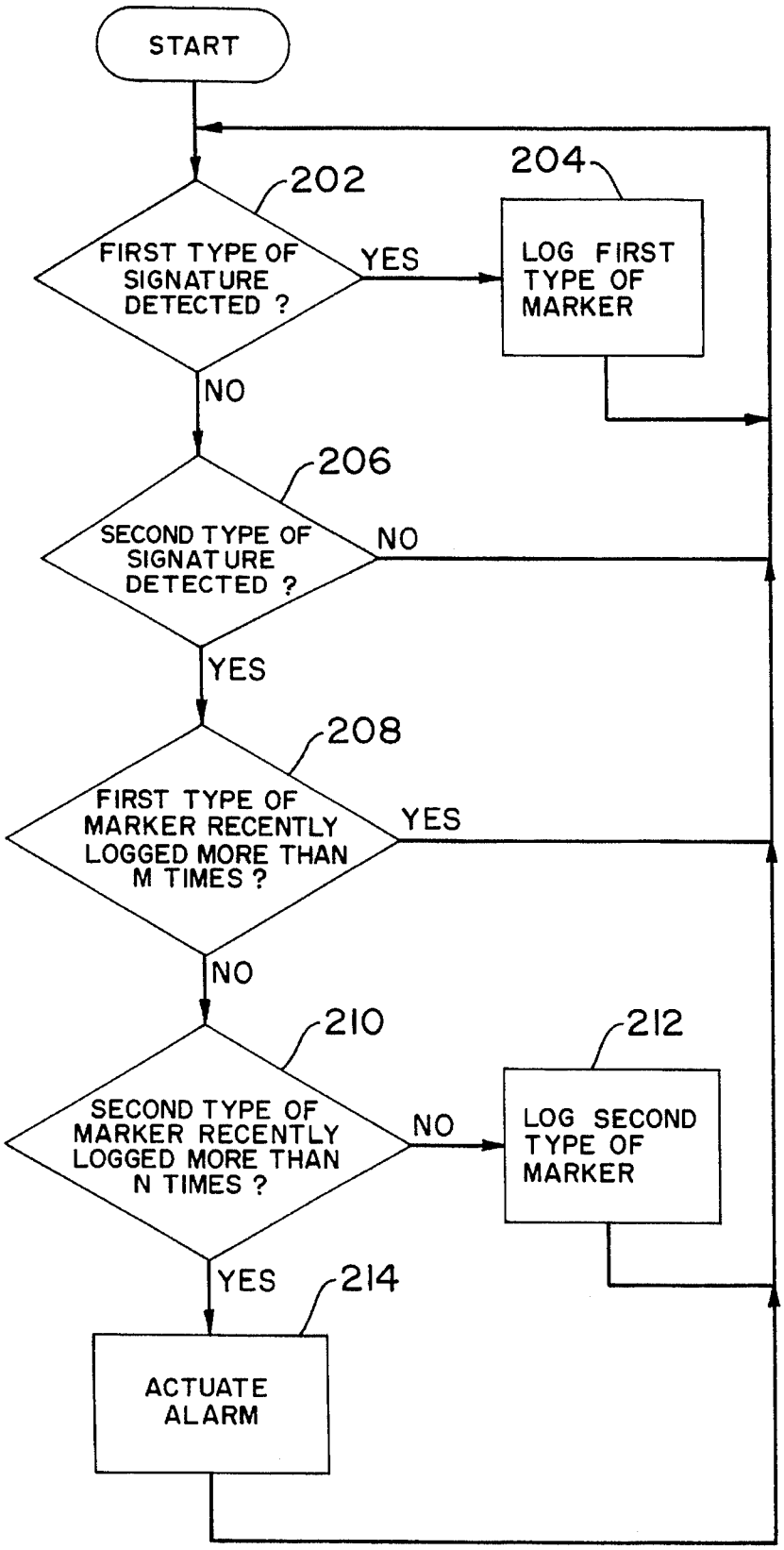
FIG. 5 is a flow chart which illustrates state estimation processing carried out in regard to neural network output signals as part of the signal processing illustrated in FIG. 2.

Another technique for avoiding false alarms caused by the first type of marker is illustrated in FIG. 5, which is a flow chart indicating a further processing routine carried out in the state estimator block 112. According to the routine of FIG. 5, it is first determined, at step 202, whether a signature of the first type of marker has been detected (i.e., OP1=1). If so, the time at which the first type of marker was detected is logged (step 204) and the routine loops back to step 202. Otherwise, step 202 is followed by step 206, at which it is determined whether the signature of the second type of marker is detected (i.e., OP2=1). If not, the routine simply loops back again to step 202. But if OP2=1, the routine proceeds to step 208, at which it is determined whether the first type of marker has recently been detected more than a predetermined number of times (M times). If so, then the detection of the second type of signature at step 206 is disregarded, and it is assumed that the second type of signature has been generated by a first type of marker which is being conveyed through the interrogation zone and which, after generating a number of signals having the first type of signature, has been brought into a position within the interrogation zone at which the marker is driven strongly enough to generate the high harmonic perturbations typically exhibited by the second type of marker.

On the other hand, if at step 208 it is determined that the first type of marker has not recently been logged more than M times, then the routine proceeds to step 210 at which it is determined whether the second type of marker has been recently detected more than N times. If not, it remains a possibility that a transient noise spike may be masquerading as the second type of marker signature, and the routine accordingly logs the detection of the second type of signature (step 212), and then loops back to step 202.

However, if at step 210 it is discovered that the most recent detection of the second type of signature follows at least N previous recent loggings of the second type of signature, then it is determined that a marker of a second type is present in the interrogation zone, and appropriate steps such as actuating an alarm (step 214) are carried out.

For the purposes of the routine of FIG. 5, N might be set as equal to 1, so that only 2 signatures of the second type need be detected (assuming an absence of signatures of the first type) within a given, brief period of time, for an alarm to be actuated. This would be sufficient to prevent the system from generating false alarms in response to occasional signal spikes that happen to resemble the second type of signature. The time period for step 210 might be set to be slightly longer than one cycle of the interrogation field signal, so that OP2=1 detected in two successive interrogation signal cycles would result in an alarm.

Moreover, M may be set to a reasonably small value, such as 1 or 2 and the time period in question might correspond to the period of time required normally to traverse the interrogation zone. In this way, the fact that a signature representing a marker of the first type has recently been detected would prevent a second type of signature generated by that first type of marker from being misinterpreted as representing the presence of the second type of marker.

A procedure for "training" the neural network, that is, for generating the weighting coefficients and bias values needed to define the nodes of the network algorithm, will now be described with reference to FIG. 6, which illustrates the training procedure in the form of a flow chart.

Figure 6:
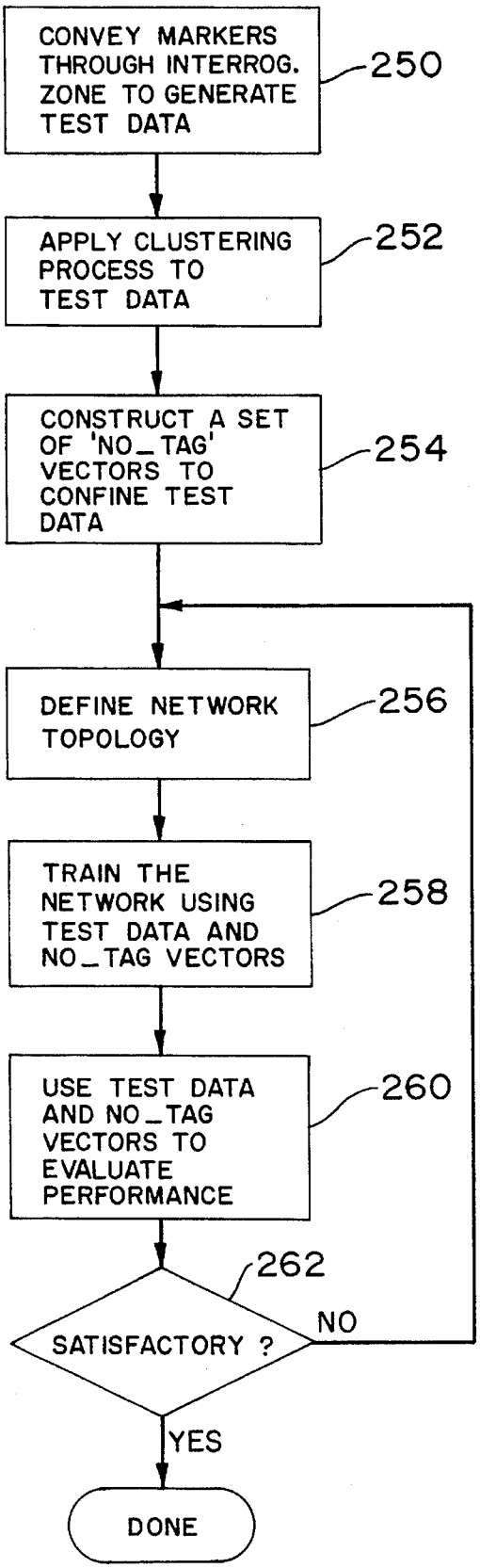
FIG. 6 is a flow chart which illustrates a procedure used for training the neural network device incorporated in the system of FIG. 1.

The first step of the procedure of FIG. 6 is step 250, and is concerned with generating test data. In step 250, an EAS system like the system 10 shown in FIG. 1 is set up and placed in operation and markers of the types of interest are conveyed on predetermined paths through the interrogation zone 17 to generate marker detection signals, or, more precisely, data sets indicative of the signatures of the markers. A test fixture (not shown) is provided to facilitate the movement of the markers through the interrogation zone 17 along predetermined paths. Preferably, each path is straight, level, and in a plane that is parallel to the planes of the antennas 14 and 22. Each path preferably passes through a respective point in a grid that is defined in the interrogation zone 17 and in a plane perpendicular to the planes of the antennas. For example, the grid may be formed of points separated from each other at regular intervals in the horizontal and vertical direction of, for example, 10 cm. For typical antennas having a height of about 1 meter, and separated by distance of about 0.8 meters, a suitable grid of points for defining the locations of the paths may be formed of about 70 points arranged in 10 rows and 7 columns. The distance traversed on each path may be on the order of 0.6 meters, and the markers are conveyed through the interrogation zone at a speed such that it takes about 2 seconds for the marker to traverse the zone.

While being conveyed through the interrogation zone, each marker generates a signal 20 (FIG. 1) in response to the interrogation signal 16, and that signal 20 is received at the antennas 14 and 22 and subjected to the signal processing previously described in connection with blocks 24L, 24R through 28L, 28R of FIG. 1, as well as the processing described in connection with blocks 100L, 100R through 108L, 108R of FIG. 2.

Given the processing timing previously described, which results in generating respective sets of six normalized parameter values at intervals of about 50 ms, it will be appreciated that about 35 such sets of parameter values will be generated each time a marker is conveyed through the interrogation zone.

Since each marker used to generate the test data is conveyed through the zone about 70 times, a total of roughly 2,000 sets of parameter values is generated for each marker.

In a conceptual sense, each data set of six parameter values can be considered to represent a respective vector or point in six-dimensional space. The purpose of the training for the network is to define boundaries between regions containing different types of data points.

Preferably, the EAS system 10 used for generating the test data includes a microcomputer programmed to perform the processing indicated in the blocks 100L, 100R through 108L, 108R and also to generate and maintain a data base of the sets of parameter values making up the test data. It will be recognized that no indicator 33 will be required for the test system.

According to a preferred technique for generating the test data, separate data bases, each consisting of approximately 2,000 sets of parameter values, are generated for one marker of the first type (i.e, having the relatively linear hysteresis loop characteristic), for one marker of the second type (i.e., exhibiting the sharply discontinuous hysteresis loop characteristic) and for three markers of the third type (i.e, having the pinned magnetic domain walls). Of the three latter markers, it is preferred that the same be samples of such markers having three distinct lengths, such as about 38 mm, about 50 mm, and about 75 mm. According to this approach, a total of 10,000 sets of the six parameter values are obtained and stored. For the types of markers described above, it has been found that there is a sufficient degree of uniformity among the markers of first and second types and among the three sizes of the third type of marker that a single marker in each category may be taken as representative. Of course, if such uniformity does not prevail among the markers of interest, it is advisable to use a representative sampling of markers.

After the test data has been generated from all of the markers, a step 252 of the routine (FIG. 6) is performed, to generate a smaller data base of test data by applying a clustering process or algorithm to the full data base. For example, a neural network technique known as learning vector quantization (LVQ) may be applied to the approximately 2,000 data sets generated for each marker to obtain roughly 100 clustered data sets for each of the five markers used to generate the test data. It is preferred that the clustering algorithm be carried out in a suitably programmed microcomputer, which may be the same microcomputer used to generate and store the test data base. As a result, at the end of step 252, both the full test data base, and a clustered test data base of about one-twentieth the size of the full test data base, have been generated and stored.

Figure 7:
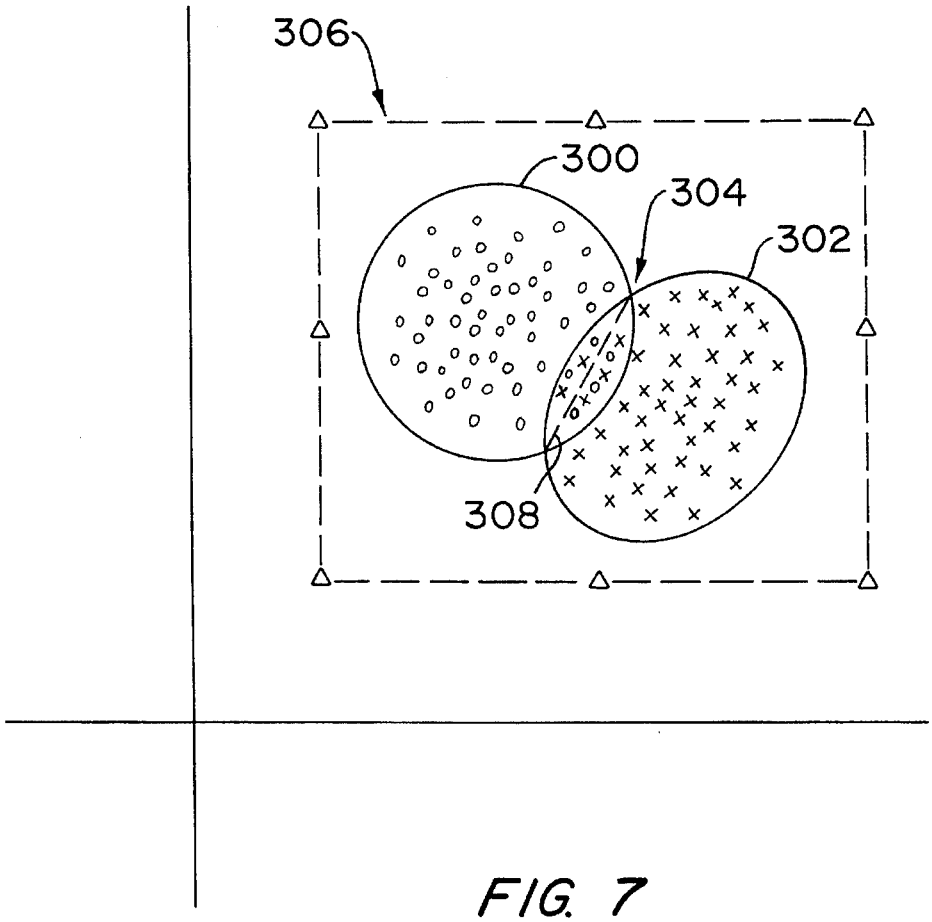
FIG. 7 schematically illustrates decision regions indicating the presence or absence of two types of article surveillance marker.

The next step of the procedure of FIG. 6 is step 254, in which a set of data vectors are generated in order to define a region of data vectors representative of the absence of any of the three types of markers. The construction of the vectors defining the region corresponding to the absence of any type of marker, which vectors will sometimes be referred to as "no_tag" vectors, is schematically illustrated in FIG. 7.

It will be recalled that the full data base and also the clustered data base are made up of vectors or points defined in a six-dimensional space, with the dimensions corresponding to six degrees of freedom provided by the six parameter values which make up each set of test data in the data bases. However, for the purpose of explaining the strategy used to construct the no_tag vectors, a two-dimensional example will now be given with reference to FIG. 7. In FIG. 7 a substantially circular region 300 is assumed to enclose all of the clustered data vectors (represented by small open circles) derived from the data generated using markers of the first type. Similarly, a substantially circular region 302 is assumed to enclose all of the data vectors (marked by small X's) derived by clustering the data generated by the second and third types of marker. It will be noted that there is a region 304 formed by overlapping of the regions 300 and 302. This overlapping region is a result of the tendency of markers of the first type to generate relatively high harmonics so as to mimic the signature characteristic of markers of the second and third type when a marker of the first type is exposed to a particularly strong interrogation signal.

A square 306 (corresponding in a practical example of step 254 to a hypercube in six dimensions) is defined in such a manner as to rather closely confine both of the regions 303 and 302. The "no_tag" vectors to be defined can then be taken as the corners and midpoints of the edges of the square 306, as indicated by the small open triangles in FIG. 7. In the six dimensional space in which step 254 is actually performed in a preferred embodiment, it will be recognized that the corners and midpoints of the edges of the corresponding 6-D hypercube amount to a total of 128 points, which are to be used as no_tag data vectors. Thus, step 254 concludes with three types of data having been generated and stored: (1) the initial test data generated by conveying markers through an interrogation zone, (2) clustered data generated from the test data, and (3) no_tag data points constructed so as to define a region which confines all of the clustered data points. Although the hypercube corners and midpoints have been used as being relatively easy to define as well as relatively efficient, it will be recognized that confinement regions of different shapes may be used, and also, that the points may be selected from the perimeter of the confinement region according to a pattern that is of greater or lesser density than the pattern shown schematically in FIG. 7.

The next step to be carried out in the procedure of FIG. 6 is step 256, in which the neural network to be trained is initialized by defining the number of layers to be included in the network, and the number of nodes in each layer. The number of inputs for the network are determined by the nature of the input data. As noted above, the processing carried out at steps 100L, 100R to 108L, 108R produced input parameter value sets of six values each. The desired number of outputs, which is two according to a preferred embodiment, was determined based on the desire to provide a system which could detect the presence of two different kinds of marker. It was considered to be advisable to provide three layers in the network (two hidden layers and one output layer), because it has been shown that a three layer network is capable of implementing any arbitrary function. Thus, using more than three layers would probably tend to result in unnecessary complexity, while using fewer than three layers would result in some restriction on the capabilities of the system. In determining how many nodes to incorporate in each layer, it should be recognized that a larger number of nodes permits the system to generate decision boundaries with greater precision, while reducing the number of nodes reduces the amount of computation required during training and operation of the system. Since the present system was intended to develop two nearly independent decision regions in a six-dimensional space, a total of 18 nodes was selected for the first hidden layer in order to provide an adequate degree of complexity for the decision region boundary, without requiring an undue amount of calculation. It is known that multi-layer perceptrons often operate with appropriate degrees of efficiency and precision if the second layer has half as many nodes as the first layer, and the second layer was accordingly defined as having 9 nodes. The number of nodes in the output layer was determined by the desired number of outputs, in this case 2.

Once the network topology has been defined, the routine of FIG. 6 continues with step 258, in which the network nodes are defined with random, small values for the weighting coefficients and bias values, and then a known training algorithm such as the error backpropagation rule is employed. The backpropagation algorithm is applied using, initially, only the clustered data vectors and the no_tag vectors. For the cluster vectors generated with respect to the first type of marker, the outputs OP1=1 and OP2=0 are provided as the "correct" outputs. Then the neural network, in its present state, is applied to the input parameter value sets and the resulting outputs are compared with the "correct" values to generate error amounts, which are backpropagated. Similarly, for the cluster data derived from the other markers, OP1=0 and OP2=1 are given as the "correct" output values, and for the no_tag vectors, the "correct" output values are OP1=0 and OP2=0. The backpropagation algorithm is performed iteratively for a period of time on the cluster data and the no_tag vector data, and then further training is performed using the complete data sets from which the cluster data was generated. It is desirable to commence the training with the cluster data because this shortens the overall period required for training.

In general, the training continues either for a predetermined number of iterations, or until the error has been minimized below a predetermined tolerance level. In the neural network having the topology described above, and using the above-described training data, a training period of approximately two days was found to produce a satisfactory convergence of the network (i.e., convergence of the weighting coefficients and bias values). This is considered to be a reasonable period of time given that the resulting weighting coefficients and bias values can then be used in every subsequent installation of the class of EAS systems.

Because the regions 300 and 302 (FIG. 7), which bound respectively the data points for the two types of marker, are not disjoint, the result of step 258 will be a boundary 308 "between" regions 300 and 302 that actually divides the region 304 shared by the regions 300 and 302. Errors caused by the ambiguity represented by shared region 304 are handled by the state estimator block 112 (FIG. 2) which was previously described.

After completion of step 258, the routine of FIG. 6 proceeds to step 260, at which some or all of the test data and the no_tag vector data is used to evaluate the performance of the trained network. If the system performance is found to be satisfactory (step 262) then the training procedure is complete. Otherwise, the network topology can be redefined (e.g., by increasing the number of nodes if the system is not accurate enough, or decreasing the number of nodes if the system is too slow) and steps 258, 260 and 262 are repeated.

It is to be understood that software tools are commercially available to aid in carrying out steps 252, 256 and 258. For example, the LVQ portion of the MATLAB® "Neural Network Tool Box," published by The MathWorks Inc., Natick, Massachusetts, may be used for the clustering performed at step 252. The same "tool box" also includes functions which facilitate defining the network topology and carrying out the backpropagation training procedure. Another software function distributed under the trademark "MATLAB" is useful in constructing appropriate no_tag vector points in hyperspace, as required for step 254. Functions from the above-mentioned "tool box" can also be used to implement the neural network shown in FIG. 3 after the weighting coefficients and bias values have been determined by the training procedure described above.

It is believed that the strategy described in connection with FIG. 2 for converting raw input signals into a relatively small set of input parameter values (in the particular example given, six input parameter values) is a significant aspect of the present invention, inasmuch as it is not feasible to perform neural network processing on large quantities of raw data. However, it is within the contemplation of this invention to use variations of, and alternatives to, the data reduction strategy described hereinabove. For example, it is contemplated to use a larger or smaller number of input parameter values than six. In particular, the number of parameter values could be increased by combining the FFT coefficient magnitudes within a larger number of frequency bands or, alternatively, the number of frequency bands could be reduced, resulting in a smaller number of parameter values. It will also be recognized that transformations other than the FFT could be utilized. One alternative type of transform that could be used is the wavelet transform.

Figure 2A:
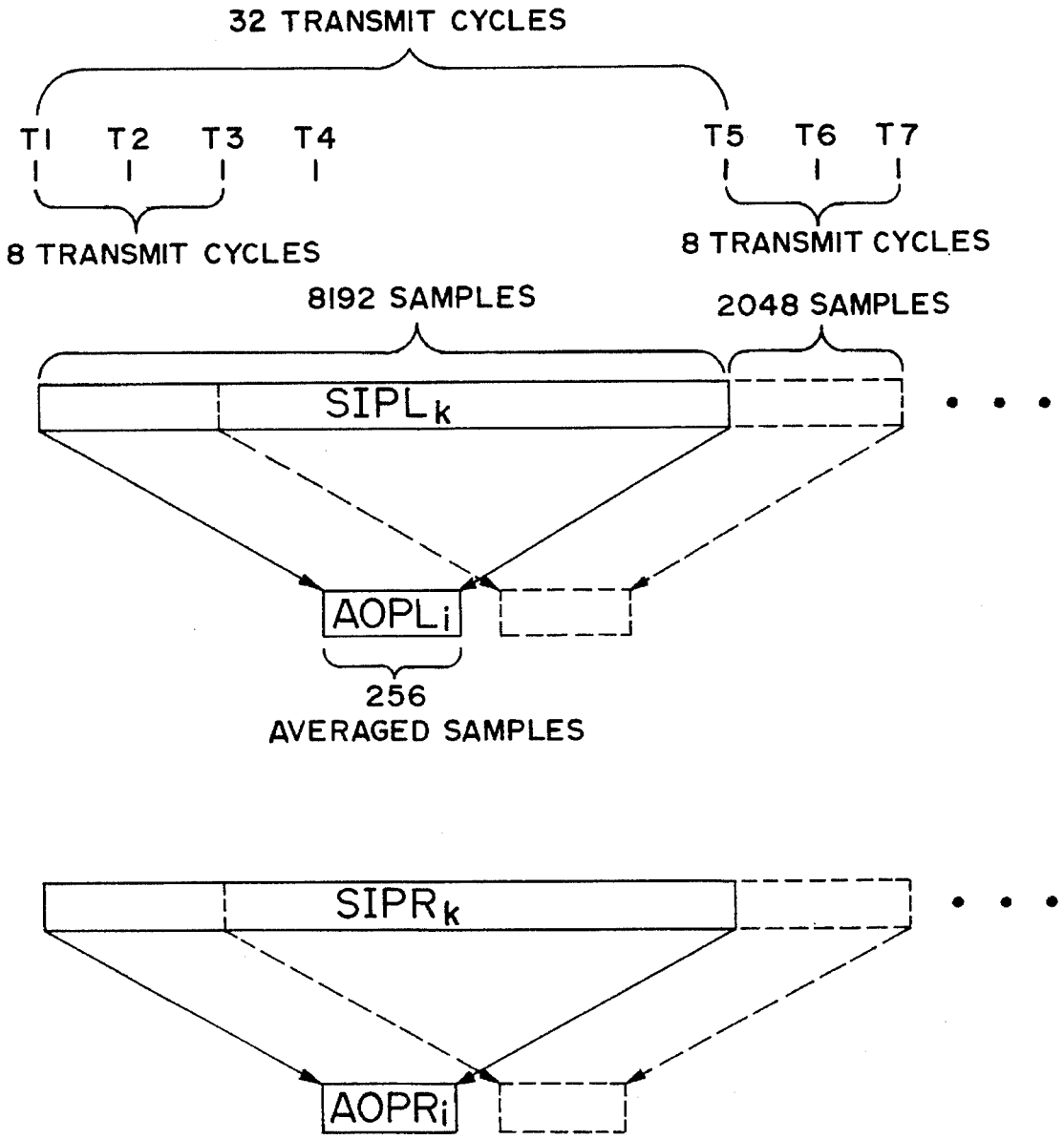
FIG. 2A is a timing chart which illustrates noise-reduction processing carried on in the digital signal processing component.

Still another alternative data reduction approach contemplated by the invention is taking the digital sample time series resulting from A/D conversion, with or without the averaging technique illustrated in FIG. 2A, and then discarding all but, say, 20 of the digital samples per transmission cycle (i.e., interrogation field signal cycle) with the remaining 20 samples being selected to correspond to the portion of the cycle at which the marker changes its magnetic polarity. These 20 samples would then make up a set of input parameter values indicative of the marker's signature characteristic. Although this would be a larger set than that used in the preferred embodiment which has chiefly been described herein, it is believed that neural network processing could be feasibly applied to this number of input values.

As still another alternative data reduction technique, the portion of the received signal corresponding to periods in which the marker changes magnetic polarity could be analyzed to estimate a pole-zero model of the marker, and a resulting set of parameter values (e.g., 4 poles and 4 zeros) could be generated to represent the characteristics of the marker.

It is also contemplated that numerous variations could be made in the neural network processing techniques described above. For example, the number of outputs, and correspondingly the number of nodes in the output layer, could be reduced to one, if the system is only required to judge the presence or absence of a single kind of marker, or could be increased to three or more, if, for instance, the system is to be optionally used with three or more different kinds of marker exhibiting mutually different signature characteristics.

Although the embodiment most particularly described herein operates with two types of markers which are subject to a degree of ambiguity, as indicated in FIG. 7, it is also contemplated to apply the present invention so as to detect two or more markers without a substantial degree of ambiguity in their signature characteristics. In this case, at least some of the state estimation processing represented by block 112 could be dispensed with.

Of course, the topology of the network is determined in part by the number of input values provided, so that changes in the parameter reduction techniques resulting in a smaller or larger number of inputs than the six inputs described hereinabove would inevitably entail changes in the network topology.

Even without regard to changes in the number of input parameters, it would be possible to increase the number of nodes in order to increase the reliability of the decisions made by the network, or the number of nodes could be decreased in order to reduce training and processing time.

It is further contemplated that the nodes of the network could be implemented using non-linear functions other than the log sigmoid function. However, it is necessary that the non-linear function used be differentiable if backpropagation training is used, so that a gradient search can be carried out during training.

It is further contemplated to use other types of neural network algorithms besides a multi-layer perceptron. One type of network that could be used is a radial basis function network, an example of which is described at pages 23–26 of "Progress in Supervised Neural Networks," D. R. Hush et al., IEEE Signal Processing Magazine, January 1993, pages 8–39.

It should also be understood that other types of analog and/or digital signal conditioning techniques can be used in addition to, or instead of, the techniques referred to in connection with blocks 26L and 26R (FIG. 1) and 100L and 100R (FIG. 2).

Furthermore, although the invention has been described within the context of an EAS system that is operated with markers that generate harmonic perturbations of an interrogation field, it is also contemplated to apply the teachings of the present invention to other types of EAS systems, including systems that operate with magnetomechanical markers.

Although the neural network algorithm is portrayed in FIG. 3 in a parallel form, implementation of such an algorithm in a conventional DSP device is performed under control of a program which provides for serial execution of instructions. For example, all of the calculations required to implement the nodes in the first hidden layer L1 are carried out in an appropriate sequence, then the calculations required to implement the nodes in the second hidden layer L2 are carried out in an appropriate sequence, and then the calculations for the nodes in the output layer L3 are performed. However, it is also contemplated to carry out the algorithm of FIG. 3 by means of a processing device that includes a plurality of processing units operating in parallel, so that, for example, the respective calculations for at least some of the nodes of layer L1 are performed simultaneously.

It is also contemplated to use only a one-channel input signal rather than the two-channel input shown in FIGS. 1 and 2.

In short, it is to be appreciated that various changes in the foregoing apparatus and modifications in the described practices may be introduced without departing from the invention. The particularly preferred methods in the apparatus are thus intended in an illustrative and not limiting sense. The true spirit and scope of the invention is set forth in the following claims.

What is claimed is:

1. An electronic article surveillance system, comprising:

means for generating and radiating an interrogation signal in an interrogation zone;

antenna means for receiving an analog signal present in the interrogation zone;

first means for processing the signal received by the antenna means to form a plurality of input parameter signals; and second means for performing a neural network processing algorithm with respect to said plurality of input parameter signals for simultaneous detection and discrimination of plural characteristics of the received signal to determine whether an electronic surveillance marker of a predetermined type having predetermined signal characteristics is present in the interrogation zone.

2. An electronic article surveillance system according to claim 1, wherein said plurality of input parameter signals are digital signals, and said second means comprises a digital processing device programmed to:

multiply each of said plurality of input parameters by a respective plurality of first weighting values to form a respective plurality of first products;

sum corresponding products from each of the pluralities of first products to form a plurality of first sums; and apply a respective nonlinear function to each of the first sums to produce a plurality of first processed values, said pluralities of first weighting values, first products, first sums and first processed values all being the same in number.

3. An electronic article surveillance system according to claim 2, wherein said first means includes means for forming a sequence of digital samples from said received signal and for further processing said sequence of digital samples to form said plurality of input parameter signals.

4. An electronic article surveillance system according to claim 3, wherein said first means further includes means for performing a fast Fourier transform with respect to said sequence of digital samples to produce a plurality of coefficient values and for further processing said plurality of coefficient values to form said plurality of input parameter signals.

5. An electronic article surveillance system according to claim 4, wherein said first means further includes means for combining at least some of said coefficient values within frequency bands to produce a plurality of frequency band values and for further processing said plurality of frequency band values to form said plurality of input parameter signals.

6. An electronic article surveillance system according to claim 5, wherein said first means further includes means for dividing each of said plurality of frequency band values by a selected one of said frequency band values to generate said plurality of input parameter signals.

7. An electronic article surveillance system according to claim 6, wherein said plurality of input parameter signals consists of six input parameter signals.

8. An electronic article surveillance system according to claim 6, wherein said first means includes an integrated circuit digital signal processing device programmed to perform said functions of performing said FFT, combining said at least some of said coefficient values to produce said plurality of frequency band values, and generating said plurality of input parameter signals, whereby said integrated circuit digital signal processing means constitutes said second means.

9. An electronic article surveillance system according to claim 2, wherein said digital processing device is further programmed to:

multiply each of said plurality of first processed values by a respective plurality of second weighting values to form a respective plurality of second products;

sum corresponding products from each of the pluralities of second products to form a plurality of second sums; and apply a respective nonlinear function to each of the second sums to produce a plurality of second processed values, said pluralities of second weighting values, second products, second sums and second processed values all being the same in number.

10. An electronic article surveillance system according to claim 9, wherein said digital processing device is further programmed to:

multiply each of said plurality of second processed values by at least one respective third weighting value to form at least one respective third product;

form an output sum set consisting of at least one output sum, each output sum of said output sum set being formed by summing a respective plurality of the third products, the respective plurality of third products being the same in number as the plurality of second processed values and including third products generated from each of the second processed values; and apply a respective nonlinear function to each output sum to produce a respective output value.

11. An electronic article surveillance system according to claim 10, wherein said output sum set consists of two output sums, and two output values are produced.

12. An electronic article surveillance system according to claim 11, wherein a first one of said two output values is indicative of whether a first type of electronic surveillance marker having a first signature characteristic is present in said interrogation zone, and a second one of said two output values is indicative of whether a second type of electronic surveillance marker, having a second signature characteristic different from said first characteristic, is present in said interrogation zone.

13. An electronic article surveillance system according to claim 10, wherein said plurality of input parameters consists of six input parameters, said plurality of first processed values consists of eighteen first processed values and said plurality of second processed values consists of nine second processed values.

14. A method of performing electronic article surveillance, comprising the steps of:

receiving an analog signal present in an interrogation zone of an electronic article surveillance system;

first processing said received signal to form therefrom a plurality of input parameter signals; and second processing said plurality of input parameter signals in a neural network processing device for simultaneous detection and discrimination of plural characteristics of the received signal to determine whether an electronic surveillance marker of a predetermined type having predetermined signal characteristics is present in said interrogation zone.

15. A method according to claim 1, wherein said second processing step includes:

multiplying each of said plurality of input parameter signals by a respective plurality of first weighting values to form a respective plurality of first products;

summing corresponding products from each of the pluralities of first products to form a plurality of first sums; and applying a respective nonlinear function to each of the first sums to produce a plurality of first processed values, said pluralities of first weighting values, first products, first sums and first processed values all being the same in number.

16. A method according to claim 15, wherein said second processing step also includes:

multiplying each of said plurality of first processed values by a respective plurality of second weighting values to form a respective plurality of second products;

summing corresponding products from each of the pluralities of second products to form a plurality of second sums; and applying a respective nonlinear function to each of the second sums to produce a plurality of second processed values, said pluralities of second weighting values, second products, second sums and second processed values all being the same in number.

17. A method according to claim 16, wherein said second processing step also includes:

multiplying each of said plurality of second processed values by at least one respective third weighting value to form at least one respective third product;

forming an output sum set consisting of at least one output sum, each output sum of said output sum set being formed by summing a respective plurality of the third products, the respective plurality of third products being the same in number as the plurality of second processed values and including third products generated from each of the second processed values; and applying a respective nonlinear function to each output sum to produce a respective output value.

18. A method according to claim 17, wherein said output sum set consists of two output sums, and two output values are produced.

19. A method according to claim 18, wherein a first one of said two output values is indicative of whether a first type of electronic surveillance marker having a first signature characteristic is present in said interrogation zone, and a second one of said two output values is indicative of whether a second type of electronic surveillance marker, having a second signature characteristic different from said first characteristic, is present in said interrogation zone.

20. A method according to claim 18, wherein said plurality of input parameters consists of six input parameters, said plurality of first processed values consists of eighteen first processed values and said plurality of second processed values consists of nine second processed values.

21. A method according to claim 1, wherein said first processing step includes forming a sequence of digital samples from said received signal and further processing said sequence of digital samples to form said plurality of input parameter signals.

22. A method according to claim 21, wherein said first processing step further includes performing a fast Fourier transform with respect to said sequence of digital samples to produce a plurality of coefficient values and further processing said plurality of coefficient values to form said plurality of input parameter signals.

23. A method according to claim 22, wherein said first processing step further includes combining at least some of said coefficient values with frequency bands to produce a plurality of frequency band values and further processing said plurality of frequency band values to form said plurality of input parameter signals.

24. A method according to claim 23, wherein said first processing step further includes dividing each of said plurality of frequency band values by a selected one of said frequency band values to generate said plurality of input parameter signals.

25. A method according to claim 24, wherein said plurality of input parameter signals consists of six input parameter signals.

26. A method according to claim 1, wherein said neural network processing device comprises an integrated circuit digit signal processing device programmed to perform a neural network processing algorithm.

27. A method according to claim 26, wherein said neural network processing algorithm constitutes a multi-layer perceptron.

28. An electronic article surveillance system, comprising:

means for generating and radiating an interrogation signal in an interrogation zone;

antenna means for receiving an analog signal present in the interrogation zone;

analog filter means for filtering the analog signal received by said antenna means;

conversion means for converting the filtered analog signal into a digital signal; and an integrated circuit digital signal processing device for receiving said digital signal, calculating a plurality of input parameter values from the received digital signal and performing a neural network processing algorithm, for simultaneous detection and discrimination of plural characteristics of the received signal, with respect to said plurality of input parameter values to determine whether an electronic surveillance marker of a predetermined type having predetermined signal characteristics is present in the interrogation zone.

29. An electronic article surveillance system according to claim 28, wherein said neural network processing algorithm constitutes a multi-layer perceptron.

30. An electronic article surveillance system according to claim 29, wherein said multi-layer perceptron is formed of two hidden layers of nodes and an output layer of at least one output node.

31. An electronic article surveillance system according to claim 30, wherein said plurality of input parameter values consists of six input parameter values, a first one of said two hidden layers consists of eighteen nodes, a second one of said two hidden layers consists of nine nodes, and said output layer consists of two output nodes.

32. An electronic article surveillance system according to claim 31, wherein a respective output value is produced at each of said two output nodes, and wherein a first one of said two output values is indicative of whether a first type of electronic surveillance marker having a first signature characteristic is present in said interrogation zone, and a second one of said two output values is indicative of whether a second type of electronic surveillance marker, having a second signature characteristic different from said first characteristic, is present in said interrogation zone.

33. An electronic article surveillance system according to claim 30, wherein a respective log sigmoid function is performed at each of said nodes.

34. An electronic article surveillance system according to claim 28, wherein said integrated circuit digital signal processing device is programmed to:

perform noise-reduction processing on the received digital signal to form a noise-reduced digital signal;

perform a fast Fourier transform with respect to the noise-reduced digital signal to produce a plurality of coefficient values;

combine at least some of the plurality of coefficient values within frequency bands to produce a plurality of frequency band values; and normalize the plurality of frequency band values to produce said plurality of input parameter values.

35. An electronic article surveillance system, comprising:

means for generating and radiating an interrogation signal in an interrogation zone;

antenna means for receiving an analog signal present in the interrogation zone;

first means for processing said received signal to determine whether a first type of electronic surveillance marker having a first signature characteristic is present in said interrogation zone; and second means for processing, simultaneously with said first means, said received signal to determine whether a second type of electronic surveillance marker, having a second signature characteristic different from said first characteristic, is present in said interrogation zone.

36. An electronic article surveillance system according to claim 35, wherein said first and second means are constituted at least in part by a suitably programmed digital processing device.

37. An electronic article surveillance system according to claim 36, wherein said digital processing device is programmed to form a plurality of input parameter signals from said received signal and to apply a neural network processing algorithm to said plurality of input parameter signals, said algorithm being adapted to produce two output signals, each of said output signals being indicative of whether a respective one of said two types of marker is present.

38. An electronic article surveillance system according to claim 37, wherein said first type of electronic surveillance marker includes a magnetic element that exhibits a substantially linear hysteresis loop characteristic, and said second type of electronic surveillance marker includes a magnetic element that exhibits a hysteresis loop characteristic that includes a large nonlinearity.

39. A method of performing electronic article surveillance, comprising the steps of:

receiving a signal present in an interrogation zone of an electronic article surveillance system;

first processing said received signal to determine whether a first type of electronic surveillance marker having a first signature characteristic is present in said interrogation zone; and second, simultaneously processing said received signal to determine whether a second type of electronic surveillance marker, having a second, signature characteristic different from said first characteristic, is present in said interrogation zone.

40. A method according to claim 39, wherein said first and second processing steps are performed by forming a plurality of input parameter signals from said received signal and applying a neural network processing algorithm to said plurality of input parameter signals, said algorithm being adapted to produce two output signals, each of said output signals being indicative of whether a respective one of said two types of marker is present.

41. A method according to claim 39, wherein said first type of electronic surveillance marker includes a magnetic element that exhibits a substantially linear hysteresis loop characteristic, and said second type of electronic surveillance marker includes a magnetic element that exhibits a hysteresis loop characteristic that includes a large nonlinearity.

42. A method of discriminating between a first type of article surveillance marker and a second type of article surveillance marker, said first type of article surveillance marker exhibiting a signature characteristic that varies, as said first type of marker is transported through an article surveillance interrogation zone, between a first condition in which said signature characteristic is substantially different from a signature characteristic of said second type of marker and a second condition in which said signature characteristic of said first type of marker is similar to the signature characteristic of said second type of marker, the method comprising the steps of:

receiving signals that are present in said article surveillance interrogation zone at respective times over a predetermined period of time;

forming a sequence of samples corresponding to said signals received during said predetermined period of time;

analyzing each sample of a first group of samples to detect whether each sample of said first group is indicative of said signature characteristic of said first type of marker, said first group of samples consisting of at least some of said sequence of samples; and simultaneously, analyzing each sample of a second group of samples to detect whether each sample of said second group is indicative of said signature characteristic of said second type of marker, said second group of samples consisting of at least some of said sequence of samples; and actuating an alarm if at least a first predetermined number of said samples of said second group of samples is detected as being indicative of said signature characteristic of said second type of marker, unless at least a second predetermined number of samples of said first group of samples is detected as being indicative of said signature characteristic of said first type of marker.

43. A method according to claim 42, wherein said first and second groups of samples each consist of said sequence of samples.

44. A method according to claim 42, wherein said second predetermined number of samples is one sample.

45. A method according to claim 42, wherein said first predetermined number of samples is two samples.

46. A method according to claim 42, wherein said alarm is actuated unless said signature characteristic of said first type of marker is detected before said signature characteristic of said second type of marker.

47. A method according to claim 42, wherein said first type of article surveillance marker includes a magnetic element that exhibits a substantially linear hysteresis loop characteristic, and said second type of article surveillance marker includes a magnetic element that exhibits a hysteresis loop characteristic that includes a large nonlinearity.

48. An apparatus for discriminating between a first type of article surveillance marker and a second type of article surveillance marker, said first type of article surveillance marker exhibiting a signature that varies, as said first type of marker is transported through an article surveillance interrogation zone, between a first condition in which said signature characteristic is substantially different from a signature characteristic of said second type of marker and a second condition in which said signature characteristic of said first type of marker is similar to the signature characteristic of said second type of marker, the apparatus comprising:

means for generating and radiating an interrogation signal in said interrogation zone;

antenna means for receiving signals that are present in said article surveillance interrogation zone at respective times over a predetermined period of time;

means for forming a sequence of samples corresponding to said signals received during said predetermined period of time;

first means for analyzing each sample of a first group of samples to detect whether each sample of said first group is indicative of said signature characteristic of said first type of marker, said first group of samples consisting of at least some of said sequence of samples;

second means for analyzing, simultaneously with said first means, each sample of a second group of samples to detect whether each sample of said second group is indicative of said signature characteristic of said second type of marker, said second group of samples consisting of at least some of said sequence of samples; and means for actuating an alarm if at least a first predetermined number of said samples of said second group of samples is detected as being indicative of said signature characteristic of said second type of marker, unless at least a second predetermined number of samples of said first group of samples is detected as being indicative of said signature characteristic of said first type of marker.

49. An apparatus according to claim 48, wherein said first and second groups of samples each consist of said sequence of samples.

50. An apparatus according to claim 48, wherein said second predetermined number of samples is one sample.

51. An apparatus according to claim 48, wherein said first predetermined number of samples is two samples.

52. An apparatus according to claim 48, wherein said alarm is actuated unless said signature characteristic of said first type of marker is detected before said signature characteristic of said second type of marker.

53. An apparatus according to claim 48, wherein said first type of article surveillance marker includes a magnetic element that exhibits a substantially linear hysteresis loop characteristic, and said second type of article surveillance marker includes a magnetic element that exhibits a hysteresis loop characteristic that includes a large nonlinearity.

* * * * *

UNITED STATES PATENT AND TRADEMARK OFFICE

CERTIFICATE OF CORRECTION

PATENT NO. : 5,537,094

DATED : July 16, 1996

INVENTOR(S) : Dale R. Bettine, et al.

It is certified that error appears in the above-identified patent and that said Letters Patent is hereby corrected as shown below:

Col. 10, line 17, delete "UK Of" and insert --$u_k$of--.

Col. 19, line 49, delete "claim 1" and insert – claim 14 –.

Col. 20, line 39, delete "claim 1" and insert – claim 14 –.

Col. 20 line 64, delete "claim 1" and insert – claim 14 –.

Signed and Sealed this

Fifth Day of January, 1999

*Attest:*

*Attesting Officer*

*Acting Commissioner of Patents and Trademarks*